US011236562B2

(12) United States Patent
Li et al.

(10) Patent No.: US 11,236,562 B2
(45) Date of Patent: Feb. 1, 2022

(54) SAFETY DRILLING SYSTEM AND METHOD FOR PREVENTING COLLAPSE OF WATER-SENSITIVE FORMATION IN UPPER PART OF HIGH-PRESSURE SALTWATER LAYER

(71) Applicant: SOUTHWEST PETROLEUM UNIVERSITY, Chengdu (CN)

(72) Inventors: Qian Li, Chengdu (CN); Xiaolin Zhang, Chengdu (CN); Hu Yin, Chengdu (CN); Wenfeng Yin, Chengdu (CN); Jiajia Gao, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 16/814,943

(22) Filed: Mar. 10, 2020

(65) Prior Publication Data

US 2021/0222528 A1 Jul. 22, 2021

(30) Foreign Application Priority Data

Jan. 19, 2020 (CN) ..... 202010060448.8

(51) Int. Cl.

| | |
|---|---|
| ***E21B 21/10*** | (2006.01) |
| ***E21B 21/08*** | (2006.01) |
| ***E21B 43/12*** | (2006.01) |
| *E21B 41/00* | (2006.01) |

(52) U.S. Cl.

CPC ..... *E21B 21/106* (2013.01); *E21B 21/08* (2013.01); *E21B 43/121* (2013.01); *E21B 41/0021* (2013.01); *E21B 41/0099* (2020.05)

(58) Field of Classification Search

CPC ..... E21B 21/00; E21B 21/08; E21B 21/10; E21B 21/106

See application file for complete search history.

(56) References Cited

U.S. PATENT DOCUMENTS

2018/0320464 A1* 11/2018 Heitmann ..... E21B 31/03

* cited by examiner

*Primary Examiner* — Robert E Fuller

(74) *Attorney, Agent, or Firm* — Bayramoglu Law Offices LLC

(57) ABSTRACT

A safety drilling system for preventing collapse of water-sensitive formation in the upper part of a high-pressure saltwater layer, which includes a wellhead equipment, a downhole drilling tool, a first injection pipeline, a second injection pipeline, a first return pipeline and a second return pipeline. Upon encountering a high-pressure saltwater layer while drilling, the system injects heavy mud into the annulus of a wellhead through the first injection pipeline to form a heavy mud cap, such that a fluid column pressure in the annulus balances the pressure of the high-pressure saltwater layer. In this case, a fluid column pressure in a drill string is lower than the pressure of the high-pressure saltwater layer.

13 Claims, 3 Drawing Sheets

SAFETY DRILLING SYSTEM AND METHOD FOR PREVENTING COLLAPSE OF WATER-SENSITIVE FORMATION IN UPPER PART OF HIGH-PRESSURE SALTWATER LAYER

CROSS REFERENCES TO THE RELATED APPLICATIONS

This application is based upon and claims priority to Chinese Patent Application No. 202010060448.8, filed on Jan. 19, 2020, the entire contents of which are incorporated herein by reference.

TECHNICAL FIELD

The present invention relates to the technical field of oil and gas drilling, in particular to a safety drilling system and method for preventing collapse of water-sensitive formation in the upper part of a high-pressure saltwater layer.

BACKGROUND

In oil and gas drilling projects, high-pressure saltwater layers are often encountered, which invade the annulus of a shaft and return upwards with drilling fluid. At this time, if there is a water-sensitive mudstone formation in the upper part of the high-pressure saltwater layer, saltwater intruding into the wellhead comes into contact with mudstones in an open hole section, and hydration and expansion will cause the instability of the well wall and collapse of the borehole, resulting in complex downhole accidents such as obstacles and jamming of a drilling tool. At present, oil-based mud and an underbalanced pressure-controlled drainage technology are mainly used to solve the problem of safety drilling of high-pressure saltwater layers. By effectively controlling a fluid column pressure profile in the annulus of the shaft, the high-pressure saltwater in the formation flows into the wellhead in a controlled manner at a certain proportion to prevent mudstone hydration and expansion as much as possible and circulates to the ground surface for treatment or separation. However, this technology still has certain limitations: during the drainage of saltwater, as the saltwater in the annulus returns upwards and contacts with the water-sensitive mudstone in the upper open hole wall, mudstone hydration and expansion cannot be avoided, and there are still risks of instability of the well wall and collapse of the wellhead; it is impossible to drill while saltwater is discharged, which consumes a lot of time and increases the drilling cost.

SUMMARY

The present invention aims to overcome the shortcomings of the prior art, and provide a safety drilling system and method for preventing the collapse of water-sensitive formation in the upper part of a high-pressure saltwater layer, which solves the problems of the deterioration of drilling fluid performances and the collapse of the well wall caused by the intrusion of high-pressure saltwater into a shaft.

The object of the present invention is achieved through the following technical solution: a safety drilling system for preventing collapse of water-sensitive formation in the upper part of a high-pressure saltwater layer comprises wellhead equipment, a downhole drilling tool, a first injection pipeline, a second injection pipeline, a first return pipeline and a second return pipeline; the wellhead equipment comprises a drilling spool provided at a wellhead, wherein a ram blowout preventer and a rotary blowout preventer are sequentially provided at the top of the drilling spool; a kill manifold is connected to a left port of the drilling spool, and a tee joint I, a flat valve A and a throttle manifold are sequentially connected to another port of the drilling spool; the downhole drilling tool comprises a positive and negative cyclic dual-use drill bit, a resistivity measurement nipple, a drill collar, a drill pipe, a drill string plug valve and a top drive which are arranged in the well and are sequentially connected from bottom to top; the first injection pipeline comprises a mud pump, a tee joint II, a flat valve B, a high-pressure manifold I, a high-pressure hose I, a flat valve C and a rotary blowout preventer which are sequentially connected; the second injection pipeline comprises a mud pump, a tee joint II, a flat valve D, a high-pressure manifold II, a vertical pipe I, a flat valve E, a tee joint III, a water hose and a top drive which are sequentially connected; the first return pipeline comprises a top drive, a water hose, a tee joint III, a flat valve F, a vertical pipe II, a tee joint IV, a flat valve G, a sand discharge pipeline, a vibrating sieve and a mud tank which are sequentially connected; the second return pipeline comprises a drilling spool, a tee joint I, a high-pressure hose II, a flat valve H, a tee joint IV, a flat valve G, a sand discharge pipeline, a vibrating sieve and a mud tank which are sequentially connected.

A flow meter I and a pressure gauge I are sequentially connected between a right port of the drilling spool and the tee joint I.

A flow meter II and a pressure gauge II are sequentially connected between the rotary blowout preventer and the flat valve C.

A flow meter III and a pressure gauge III are sequentially connected between the water hose and the tee joint III.

The safety drilling system further comprises auxiliary equipment, the auxiliary equipment including a ground pipeline II, a liquid-gas separator, and a ground pipeline I, wherein the surface pipeline II is connected between the mud pump and the kill manifold, and the ground pipeline I and a liquid-gas separator are sequentially connected to the throttle manifold.

A flat valve II is connected between a right port of the drilling spool and the flow meter I; and a flat valve I is connected between a left port of the drilling spool and the kill manifold.

A method for preventing collapse of water-sensitive formation in the upper part of a high-pressure saltwater layer by using the safety drilling system comprises the following steps:

S1: a conventional drilling mode which specifically includes the following steps:

S11: closing a flat valve I and opening a flat valve II;

S12: closing a flat valve A, a flat valve B, a flat valve C and a flat valve F; opening a flat valve D, a flat valve E, a flat valve H and a flat valve G, that is, performing conventional positive cyclic drilling by using a drill bit under the condition that a second injection pipeline and a second return pipeline are kept smooth;

S13: monitoring the resistivity of the drill bit through a resistivity measurement nipple in real time, wherein if the resistivity decreases, it means that the drill bit is encountering the high-pressure saltwater layer while drilling; and in this case, closing the flat valve E and the flat valve H, stopping cyclic drilling, recording a pressure displayed on a pressure gauge III, and calculating a pressure of the high-pressure saltwater layer in combination with the density of drilling fluid;

S2: from the conventional drilling mode to an anti-collapse drilling mode, the following steps are specifically included:

S21: closing the flat valve II; opening the flat valve A, the flat valve B, the flat valve C, the flat valve F, and the flat valve H; and closing the flat valve D and the flat valve G;

S22: calculating a height of an annulus heavy mud cap and heavy mud volume which are required to balance the pressure of the high-pressure saltwater layer according to the pressure of the high-pressure saltwater layer, the density of the drilling fluid and the density of reserve heavy mud;

S23: turning on the mud pump; injecting isolation fluid and heavy mud into the annulus of a wellbore sequentially through the mud pump, a tee joint II, the flat valve B, a high-pressure manifold I, a high-pressure hose I, the flat valve C and a rotary blowout preventer; and after the annulus mud cap and a fluid column pressure of the drilling fluid balance the pressure of the high-pressure saltwater layer, turning off the mud pump;

S24: when the fluid column pressure of the drilling fluid in a drill string is less than the pressure of the high-pressure saltwater layer, allowing a large amount of saltwater to enter the drill string through a water hole of the drill bit; allowing the saltwater to return from the wellhead sequentially through a drill collar and an inner hole of a drill pipe; allowing the returned saltwater to enter a throttle manifold sequentially through a top drive, a water hose, a tee joint III, a flat valve F, a vertical pipe II, a tee joint IV, the flat valve H, a high-pressure hose II, a tee joint I, and a flat valve A; controlling a wellhead pressure and return flow of the high-pressure saltwater by a throttle valve on the throttle manifold;

S3: from the anti-collapse drilling mode to a make-a-connection mode, the following steps are specifically included:

S31: stopping drilling, and lifting a drilling tool in the well, such that a drill string plug valve is exposed from a drill floor and stuck on the drill floor;

S32: closing a throttle valve of the throttle manifold, recording a pressure value displayed on the pressure gauge III, closing the drill string plug valve, and releasing a pressure from the ground pipeline I and the ground pipeline II;

S33: shackling from the top of the plug valve, and connecting another drill string with a drill string plug valve at the top, followed by the top drive; opening the flat valve D and the flat valve E, closing the flat valve B and the flat valve F, and turning on the mud pump; when the pressure displayed on the pressure gauge III increases to a previously recorded pressure, turning off the mud pump and opening the drill string plug valve;

S34: closing the flat valve D and the flat valve E, and opening the flat valve B and the flat valve F; releasing a pressure from the ground pipeline I and the ground pipeline II; adjusting an opening degree of the throttle valve on the throttle manifold to continue to prevent collapse and drilling;

S4: from the anti-collapse drilling mode to a drill-up mode, the following steps are specifically included:

S41: stopping drilling and lifting the drilling tool in the well; after the cuttings in the well are discharged, closing the throttle valve on the throttle manifold, recording a pressure displayed on the pressure gauge III, and closing the drill string plug valve;

S42: opening the flat valve D, the flat valve E and the flat valve II; closing the flat valve B, the flat valve C, the flat valve F and the flat valve H;

S43: turning on the mud pump; injecting heavy mud into the drill string sequentially through the mud pump, the tee joint II, the flat valve D, the high-pressure manifold II, the vertical pipe I, the flat valve E, the tee joint III, the water hose and the top drive; allowing the returned drilling fluid to enter the mud tank through the flat valve II, the tee joint I, the flat valve A, the throttle manifold, the liquid-gas separator, and the vibrating sieve; when the fluid column pressure in the drill string balances the pressure of the high-pressure saltwater layer, turning off the mud pump; when a pressure value displayed on the pressure gauge III is zero, closing the throttle valve on the throttle manifold and the flat valve A;

S44: performing annulus drill-up operation under pressure by using a rotary blowout preventer till reaching a certain position in a casing; opening the throttle valve on the throttle manifold and the flat valve A; continuously injecting heavy mud by the top drive, such that a space above the position of the drill bit, as well as the interior and exterior of the drill string in the shaft are filled with heavy mud to balance the pressure of the high-pressure saltwater layer; turning off the mud pump to complete the subsequent drilling operation; and S5. a drill-down mode, which specifically includes the following steps:

S51: closing the flat valve I and the flat valve II of the drilling spool; opening the flat valve A, the flat valve B, the flat valve C, the flat valve F, and the flat valve H; and closing the flat valve D, the flat valve E and the flat valve G;

S52: drilling downwards normally; after the drill bit reaches the bottom of the well, turning on the mud pump; injecting the drilling fluid into the annulus of the wellbore sequentially through the mud pump, the tee joint II, the flat valve B, the high-pressure manifold I, the high-pressure hose I, the flat valve C, and the rotary blowout preventer; allowing the returned fluid to enter the mud tank sequentially through the top drive, the water hose, the tee joint III, the flat valve F, the vertical pipe II, the tee joint IV, the flat valve H, the high-pressure Hose II, the tee joint I, the flat valve A, the throttle manifold, the liquid-gas separator, and the vibrating sieve; and S53: after all the heavy mud in the well returns, repeating step S2 to prevent collapse drilling.

According to the method for preventing collapse of water-sensitive formation in the upper part of the high-pressure saltwater layer by using the safety drilling system, in the step S24, the drilling can be continued during the drainage of saltwater, and the returned high-pressure saltwater carries cuttings back to the bottom of the well through the drill string.

The present invention has the following advantages:

1. the safety drilling system of the present invention can be retrofitted on the basis of existing conventional drilling equipment, with simple on-site operation and convenient process conversion;

2. by returning formation saltwater from the drill string, the saltwater entering the shaft is prevented from coming into contact with the open-hole well wall, such that the problems such as the deterioration of drilling fluid performances caused by intrusion of high-pressure saltwater into the shaft, the collapse of the well wall in a water-sensitive open-hole formation, and the like are solved, and the complexity of drilling accidents in the high-pressure saltwater formation is reduced; and 3. by returning formation saltwater from the drill string, drilling can be performed at the same time as returning the high-pressure saltwater from the formation, thereby improving the overall time efficiency of drilling and reducing the operating cost.

In drawings, reference symbols represent the following components: 1-mud pump, 2-mud tank, 3-vibrating sieve, 4-tee joint II, 5-flat valve B, 6-high-pressure manifold I, 7-high-pressure hose I, 8-flat valve C, 9-pressure gauge II, 10-flow meter II, 11-flat valve D, 12-high-pressure manifold II, 13-vertical pipe I, 14-flat valve E, 15-tee connector III, 16-pressure gauge III, 17-flow meter III, 18-water hose, 19-top drive, 20-flat valve F, 21-vertical pipe II, 22-tee connector IV, 23-flat valve G, 24-sand drainage pipeline, 25-flat valve H, 26 high-pressure hose II, 27-tee connector I, 28-flat valve A, 29-throttle manifold, 30-ground pipeline I, 31-pressure gauge I, 32-flow meter I, 33-drilling spool flat valve II, 34-drilling spool flat valve I, 35-kill manifold, 36-ground pipeline II, 37-rotary blowout preventer, 38-gate blowout preventer, 39-drilling spool, 40-drill string, 41-drill collar, 42-resistivity measurement nipple, 43-positive and negative cyclic dual-use drill bit, 44-drill string plug valve, 45-well, 46-liquid-gas separator.

DETAILED DESCRIPTION OF THE EMBODIMENTS

Figure 1:
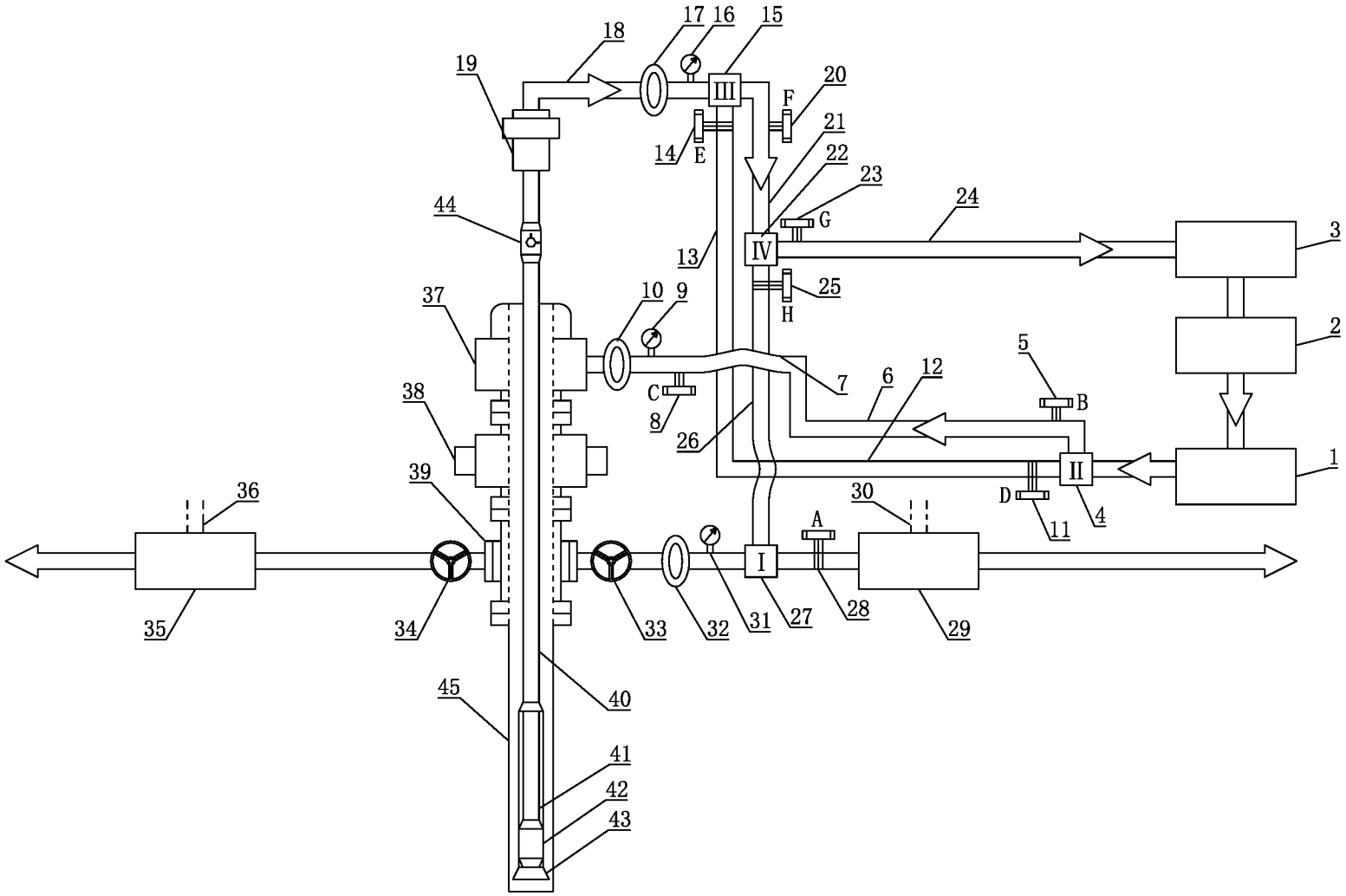
FIG. 1 is a schematic structural diagram of the present invention.
Figure 2:
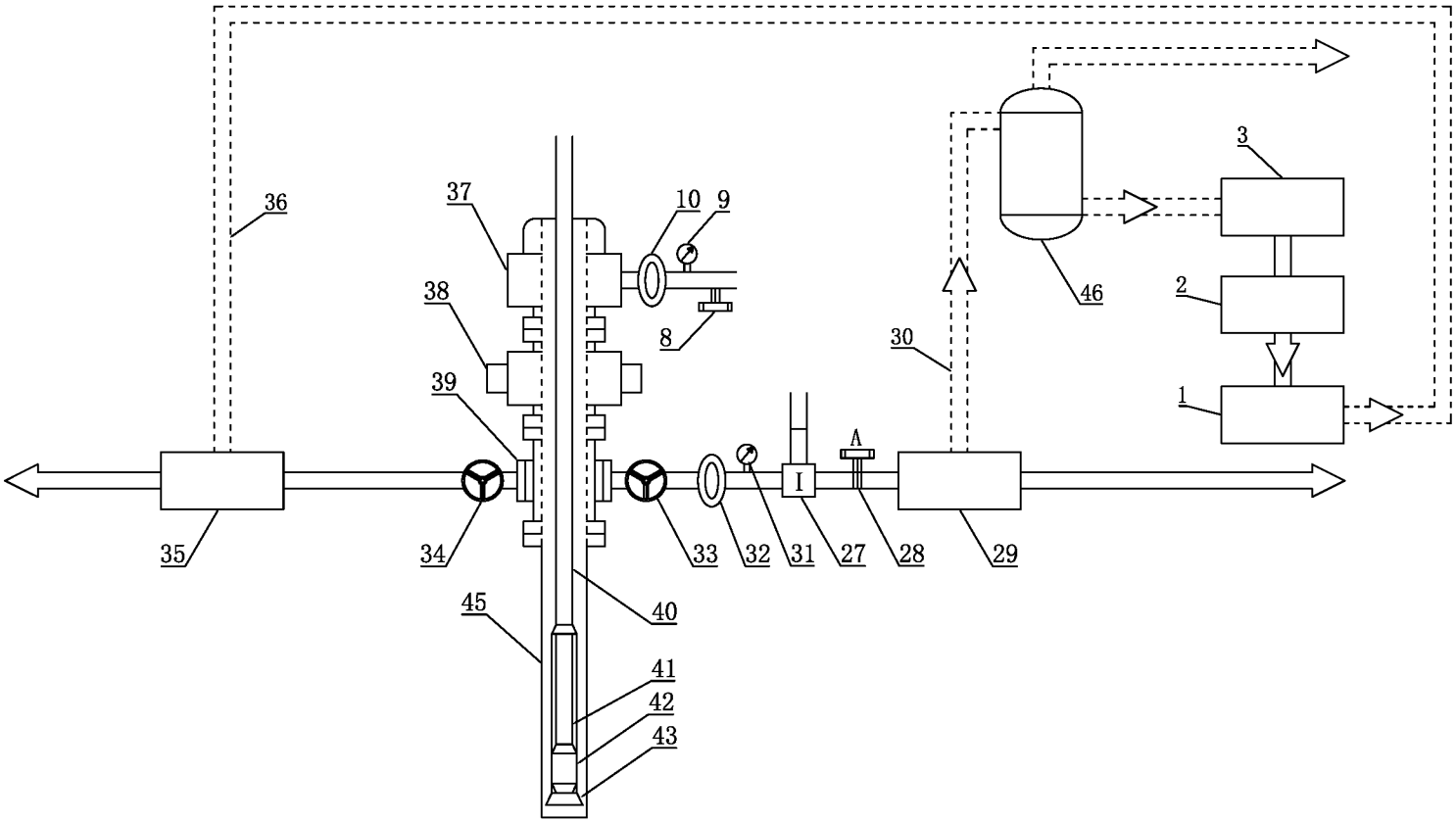
FIG. 2 is a schematic diagram showing the connection between a ground pipeline and a throttle manifold and a kill manifold.
Figure 3:
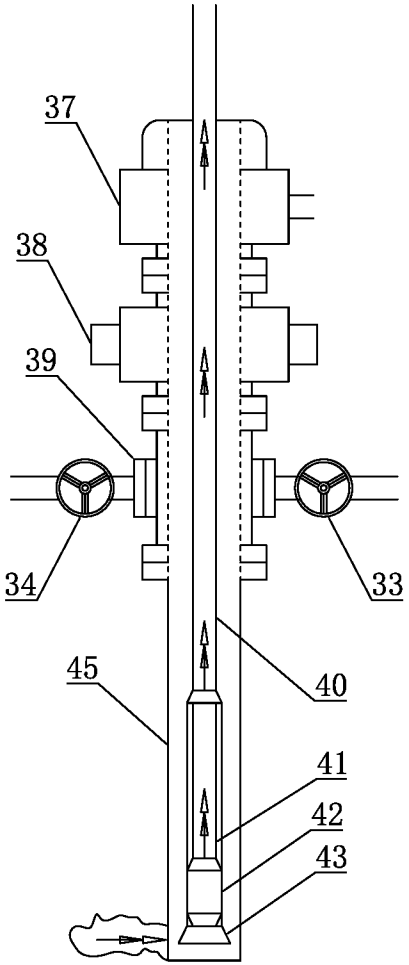
FIG. 3 is a schematic diagram showing the flow of high-pressure saltwater in the well.

The present invention is further described with reference to the accompanying drawings. The protection scope of the present invention is not limited to the followings:

As shown in FIGS. 1 to 3, a safety drilling system for preventing collapse of water-sensitive formation in the upper part of a high-pressure saltwater layer comprises wellhead equipment, a downhole drilling tool, a first injection pipeline, a second injection pipeline, a first return pipeline and a second return pipeline.

The wellhead equipment comprises a drilling spool 39 provided at a wellhead, wherein a ram blowout preventer 38 and a rotary blowout preventer 37 are sequentially provided at the top of the drilling spool 39; a kill manifold 35 is connected to a left port of the drilling spool 39, and a tee joint I 27, a flat valve A 28 and a throttle manifold 29 are sequentially connected to another port of the drilling spool 39.

The downhole drilling tool comprises a positive and negative cyclic dual-use drill bit 43, a resistivity measurement nipple 42, a drill collar 41, a drill pipe 40, a drill string plug valve 44 and a top drive 19 which are arranged in the well and are sequentially connected from bottom to top. The resistivity measurement nipple 42 is installed near the drill bit 43 and transmits a signal through a pulse. The wellhead is equipped with a matching signal receiving device, which can measure a change in the resistivity of the drilling fluid near the drill bit 43, and determine whether the saltwater has invaded into the shaft. The drill string plug valve 44 is installed on the top of each drill string, and has the functions of blowout prevention and well shut-in in the drill string.

The first injection pipeline comprises a mud pump 1, a tee joint II 4, a flat valve B 5, a high-pressure manifold I 6, a high-pressure hose 17, a flat valve C 8 and a rotary blowout preventer 37 which are sequentially connected; the second injection pipeline comprises a mud pump 1, a tee joint II 4, a flat valve D 11, a high-pressure manifold II 12, a vertical pipe I 13, a flat valve E 14, a tee joint III 15, a water hose 18 and a top drive 19 which are sequentially connected.

The first return pipeline comprises a top drive 19, a water hose 18, a tee joint III 15, a flat valve F 20, a vertical pipe II 21, a tee joint IV 22, a flat valve G 23, a sand discharge pipeline 24, a vibrating sieve 3 and a mud tank 2 which are sequentially connected.

The second return pipeline comprises a drilling spool 39, a tee joint I 27, a high-pressure hose II 26, a flat valve H 25, a tee joint IV 22, a flat valve G 23, a sand discharge pipeline 24, a vibrating sieve 3 and a mud tank 2 which are connected in series.

A flow meter I 32 and a pressure gauge I 31 are sequentially connected between a right port of the drilling spool 39 and the tee joint I 27. A flow meter II 10 and a pressure gauge II 9 are sequentially connected between the rotary blowout preventer 37 and the flat valve C 8. A flow meter III 17 and a pressure gauge III 16 are sequentially connected between the water hose 18 and the tee joint III 15.

As shown in FIGS. 1 to 2, the safety drilling system further comprises auxiliary equipment. The auxiliary equipment includes a ground pipeline II 36, a liquid-gas separator 46, and a ground pipeline I 30, wherein the surface pipeline II 36 is connected between the mud pump 1 and the kill manifold 35, and the ground pipeline 130 and a liquid-gas separator 46 are sequentially connected to the throttle manifold 29. A flat valve II 33 is connected between a right port of the drilling spool 39 and the flow meter I 32; and a flat valve I 34 is connected between a left port of the drilling spool 39 and the kill manifold 35.

A method for preventing collapse of water-sensitive formation in the upper part of a high-pressure saline layer by using the safety drilling system comprises the following steps:

S1: a conventional drilling mode which specifically includes the following steps:

S11: closing a flat valve I 34 and opening a flat valve II 33;

S12: closing a flat valve A 28, a flat valve B 5, a flat valve C 8 and a flat valve F 20; opening a flat valve D 11, a flat valve E 14, a flat valve H 25 and a flat valve G 23, that is, performing conventional positive circulation drilling by using a drill bit 43 under the condition that a second injection pipeline and a second return pipeline are kept smooth;

S13: monitoring the resistivity of the drill bit 43 through a resistivity measurement nipple 42 in real time, wherein if the resistivity decreases, it means that the drill bit 43 is encountering the high-pressure saltwater layer while drilling; and in this case, closing the flat valve E 14 and the flat valve H 25, stopping cyclic drilling, recording a pressure displayed on a pressure gauge III 16, and calculating a pressure of the high-pressure saltwater layer in combination with the density of drilling fluid;

S2: from the conventional drilling mode to an anti-collapse drilling mode, the following steps are specifically included:

S21: closing the flat valve II 33; opening the flat valve A 28, the flat valve B 5, the flat valve C8, the flat valve F 20, and the flat valve H 25; and closing the flat valve D 11 and the flat valve G 23;

S22: calculating a height of an annulus heavy mud cap and heavy mud volume which are required to balance the pressure of the high-pressure saltwater layer according to the pressure of the high-pressure saltwater layer, the density of the drilling fluid and the density of reserve heavy mud;

S23: turning on the mud pump 1; injecting isolation fluid and heavy mud into the annulus of a wellbore 45 sequentially through the mud pump 1, a tee joint II 4, the flat valve B 5, a high-pressure manifold I 6, a high-pressure hose I 7, the flat valve C 8 and a rotary blowout preventer 37; and after the annulus mud cap and a fluid column pressure of the drilling fluid balance the pressure of the high-pressure saltwater layer, turning off the mud pump 1;

S24: when the fluid column pressure of the drilling fluid in a drill string is less than the pressure of the high-pressure saltwater layer, allowing a large amount of saltwater to enter the drill string through a water hole of the drill bit 43; allowing the saltwater to return from the wellhead sequentially through a drill collar 41 and an inner hole of a drill pipe 40; allowing the returned saltwater to enter a throttle manifold 29 sequentially through a top drive 19, a water hose 18, a tee joint III 15, a flat valve F 20, a vertical pipe II 21, a tee joint IV 22, the flat valve H 25, a high-pressure hose II 26, a tee joint I 27, and a flat valve A 28; controlling a wellhead pressure and return flow of the high-pressure saltwater by a throttle valve on the throttle manifold 29;

S3: from the anti-collapse drilling mode to a make-a-connection mode, the following steps are specifically included:

S31: stopping drilling, and lifting a drilling tool in the well, such that a drill string plug valve 44 is exposed from a drill floor and stuck on the drill floor;

S32: closing the throttle value of the throttle manifold 29, recording a pressure value displayed on the pressure gauge III 16, closing the drill string plug valve 44, and releasing a pressure from the ground pipeline I 30 and the ground pipeline II 36;

S33: shackling from the top of the plug valve 44, and connecting another drill string with a drill string plug valve 44 at the top, followed by the top drive 19; opening the flat valve D 11 and the flat valve E 14, closing the flat valve B 5 and the flat valve F 20, and turning on the mud pump 1; when the pressure displayed on the pressure gauge III 16 increases to a previously recorded pressure, turning off the mud pump 1 and opening the drill string plug valve 44;

S34: closing the flat valve D 11 and the flat valve E 14, and opening the flat valve B5 and the flat valve F 20; releasing a pressure from the ground pipeline I 30 and the ground pipeline II 36; adjusting an opening degree of the throttle valve on the throttle manifold 29 to continue to prevent collapse and drilling;

S4: from the anti-collapse drilling mode to a drill-up mode, the following steps are specifically included:

S41: stopping drilling and lifting the drilling tool in the well; after all cuttings in the well are discharged, closing the throttle valve on the throttle manifold 29, recording a pressure displayed on the pressure gauge III 16, and closing the drill string plug valve 44;

S42: opening the flat valve D 11, the flat valve E 14 and the flat valve II 33; closing the flat valve B 5, the flat valve C 8, the flat valve F 20 and the flat valve H 25;

S43: turning off the mud pump 1; injecting heavy mud into the drill string sequentially through the mud pump 1, the tee joint II 4, the flat valve D 11, the high-pressure manifold II 12, the vertical pipe I 13, the flat valve E 14, the tee joint III 15, the water hose 18 and the top drive 19; allowing the returned drilling fluid to enter the mud tank 2 through the flat valve II 33, the tee joint I 27, the flat valve A 28, the throttle manifold 29, the liquid-gas separator 46, and the vibrating sieve 3; when the fluid column pressure in the drill string balances the pressure of the high-pressure saltwater layer, turning off the mud pump 1; when a pressure value displayed on the pressure gauge III 16 is zero, closing the throttle valve on the throttle manifold 29 and the flat valve A;

S44: performing annulus drill-up operation under pressure by using a rotary blowout preventer 37 till reaching a certain position in a casing; opening the throttle valve on the throttle manifold 29 and the flat valve A 28; continuously injecting heavy mud by the top drive 19, such that a space above the position of the drill bit 43, as well as the interior and exterior of the drill string in the wellhead are filled with heavy mud to balance the pressure of the high-pressure saltwater layer; turning off the mud pump 1 to complete the subsequent drilling operation; and S5. a drill-down mode, which specifically includes the following steps:

S51: closing the flat valve I 34 and the flat valve II 33 of the drilling spool; opening the flat valve A 28, the flat valve B 5, the flat valve C 8, the flat valve F 20, and the flat valve H 25; and closing the flat valve D 11, the flat valve E 14 and the flat valve G 23;

S52: drilling downwards normally; after the drill bit reaches the bottom of the well, turning on the mud pump 1; injecting the drilling fluid into the annulus of the wellbore 45 sequentially through the mud pump 1, the tee joint II 4, the flat valve B 5, the high-pressure manifold I 6, the high-pressure hose 17, the flat valve C 8, and the rotary blowout preventer 37; allowing the returned fluid to enter the mud tank 2 sequentially through the top drive 19, the water hose 18, the tee joint III 15, the flat valve F 20, the vertical pipe II 21, the tee joint IV 22, the flat valve H 25, the high-pressure hose II 26, the tee joint I 27, the flat valve A 28, the throttle manifold 29, the liquid-gas separator 46, and the vibrating sieve 3; and S53: after all the heavy mud in the well returns, repeating step S2 to prevent collapse drilling.

According to the method for preventing collapse of water-sensitive formation in the upper part of the high-pressure saline layer by using the safety drilling system, in the step S24, the drilling can be continued during the drainage of brine, and the returned high-pressure brine carries cuttings back to the bottom of the well through the drill string.

It can thus be seen that the high-pressure saltwater returns through the drill string and does not contact the open-hole well wall, such that the collapse of the well wall caused by mudstone hydration and expansion due to saltwater entering the annulus is avoided, the comprehensive efficiency is improved, the equipment modification is simple, and the process switching is convenient. The system and method are especially suitable for the formation of water-sensitive mudstones and high-pressure saltwater layers.

The above description is not intended to limit the present invention in any form. Although the present invention has been disclosed through the above embodiments, it is not intended to limit the present invention. Any person skilled in the art can make some changes or modifications to form equivalent embodiments with equivalent changes according to the technical content as disclosed above without departing from the scope of the technical solutions of the present invention. Any simple amendments, equivalent changes, and modifications made to the above embodiments according to the technical essence of the present invention without departing from the technical solutions of the present invention still fall within the scope of the technical solutions of the present invention.

What is claimed is:

1. A safety drilling system for preventing collapse of a water-sensitive formation in an upper part of a high-pressure saltwater layer, comprising a wellbore extending from a surface of the earth into the water-sensitive formation, a wellhead at the surface, a downhole drilling tool, a first injection pipeline, a second injection pipeline, a first return pipeline and a second return pipeline; wherein the wellhead comprises, arranged in the following sequence in a direction upward from the surface; a drilling spool a ram blowout preventer, and a rotary blowout preventer; a kill manifold is connected to a first port of the drilling spool located on a first side of the drilling spool, and a first tee joint, a valve A and a throttle manifold are connected to a second port of the drilling spool located on a second side of the drilling pool; the downhole drilling tool comprises, arranged in the following sequence in a direction from a bottom of the wellbore toward the surface, a drill bit, a resistivity measurement nipple, a drill collar, a drill pipe, a drill string plug valve and a top drive; the first injection pipeline comprises a mud pump, and arranged in the following sequence moving away from the mud pump, a second tee joint, a valve B, a first high-pressure manifold, a first high-pressure hose, a valve C and the rotary blowout preventer; the second injection pipeline comprises the mud pump, and, arranged in the following sequence moving away from the mud pump, the second tee joint, a valve D, a second high-pressure manifold, a first vertical pipe, a valve E, a third tee joint, a water hose and the top drive; the first return pipeline comprises the top drive, and, arranged in the following sequence moving away from the top drive, the water hose, the third tee joint, a valve F, a second vertical pipe, a fourth tee joint, a valve G, a sand discharge pipeline, a vibrating sieve and a mud tank; the second return pipeline comprises the drilling spool, the first tee joint, a second high-pressure hose, a valve H, the fourth tee joint, the valve G, the sand discharge pipeline, the vibrating sieve and the mud tank.

2. The safety drilling system of claim 1, wherein a first flow meter and a first pressure gauge are connected between the second port of the drilling spool and the first tee joint.

3. The safety drilling system of claim 2, wherein a second valve is connected between the second port of the drilling spool and the first flow meter; and a first valve is connected between the first port of the drilling spool and the kill manifold.

4. The safety drilling system of claim 1, wherein a second flow meter and a second pressure gauge are connected between the rotary blowout preventer and the valve C.

5. The safety drilling system of claim 1, wherein a third flow meter and a third pressure gauge are connected between the water hose and the third tee joint.

6. The safety drilling system of claim 1, further comprising an auxiliary equipment, the auxiliary equipment comprising a second ground pipeline, a liquid-gas separator, and a first ground pipeline, wherein the second ground pipeline is connected between the mud pump and the kill manifold, and the first ground pipeline and the liquid-gas separator are connected to the throttle manifold.

7. A method of using the safety drilling system according to claim 1, comprising the following steps:

S1: operating in a conventional drilling mode, the conventional drilling mode comprising the following steps:

S11: closing a first valve and opening a second valve;

S12: closing the valve A, the valve B, the valve C and the valve F; opening the valve D, the valve E, the valve H and the valve G, and drilling by using a drill bit under a condition wherein the second injection pipeline and the second return pipeline are kept open;

S13: monitoring resistivity of the drill bit through the resistivity measurement nipple in real time, wherein if the resistivity decreases, the drill bit is encountering the high-pressure saltwater layer while drilling; and closing the valve E and the valve H, stopping drilling, recording a pressure displayed on a third pressure gauge, and calculating a pressure of the high-pressure saltwater layer in combination with a density of a drilling fluid;

S2: transitioning from the conventional drilling mode to an anti-collapse drilling mode, the anti-collapse drilling mode comprising the following steps:

S21: closing the second valve; opening the valve A, the valve B, the valve C, the valve F, and the valve H; and closing the valve D and the valve G;

S22: calculating a height of an annulus heavy mud cap and heavy mud volume, wherein the height of the annulus heavy mud cap and heavy mud volume are required to balance the pressure of the high-pressure saltwater layer according to the pressure of the high-pressure saltwater layer, the density of the drilling fluid and a density of a reserve heavy mud;

S23: turning on the mud pump; injecting an isolation fluid and heavy mud into an annulus of the wellbore sequentially through the mud pump, the second tee joint, the valve B, the first high-pressure manifold, the first high-pressure hose, the valve C and the rotary blowout preventer; and after the annulus heavy mud cap and a fluid column pressure of the drilling fluid balance the pressure of the high-pressure saltwater layer, turning off the mud pump;

S24: when the fluid column pressure of the drilling fluid in the drill pipe is less than the pressure of the high-pressure saltwater layer, allowing an amount of saltwater to enter the drill pipe through a water hole of the drill bit; allowing the saltwater to return from the wellhead sequentially through the drill collar and an inner hole of the drill pipe; allowing returned saltwater to enter the throttle manifold sequentially through the top drive, the water hose, the third tee joint, the valve F, the second vertical pipe, the fourth tee joint, the valve H, the second high-pressure hose, the first tee joint, and the valve A; controlling a wellhead pressure and return flow of the high-pressure saltwater by a throttle valve on the throttle manifold;

S3: transitioning from the anti-collapse drilling mode to a make-a-connection mode, the make-a-connection mode comprising the following steps:

S31: stopping drilling, and lifting the drill bit in the wellbore, such that a drill string plug valve is exposed on a drill floor;

S32: closing a throttle valve of the throttle manifold, recording a pressure value displayed on the third pressure gauge, closing the drill string plug valve, and releasing a pressure from a first ground pipeline and a second ground pipeline;

S33: connecting another drill pipe between the drill string plug valve and the top drive; opening the valve D and the valve E, closing the valve B and the valve F, and opening the mud pump; when the pressure displayed on the third pressure gauge increases to a previously recorded pressure, turning off the mud pump and opening the drill string plug valve;

S34: closing the valve D and the valve E, and opening the valve B and the valve F; releasing a pressure from the first ground pipeline and the second ground pipeline; adjusting an opening degree of the throttle valve on the throttle manifold and continuing drilling;

S4: transitioning from the anti-collapse drilling mode to a drill-up mode, the drill-up mode comprising the following steps:

S41: stopping drilling and lifting the drill bit in the wellbore; after a plurality of cuttings are discharged, closing the throttle valve on the throttle manifold, recording the pressure displayed on the third pressure gauge, and closing the drill string plug valve;

S42: opening the valve D, the valve E and the second valve; closing the valve B, the valve C, the valve F and the valve H;

S43: turning on the mud pump; injecting heavy mud into the drill pipe sequentially through the mud pump, the second tee joint, the valve D, the second high-pressure manifold, the first vertical pipe, the valve E, the third tee joint, the water hose and the top drive; allowing a returned drilling fluid to enter the mud tank through the second valve, the first tee joint, the valve A, the throttle manifold, a liquid-gas separator, and the vibrating sieve; when the fluid column pressure in the drill pipe balances the pressure of the high-pressure saltwater layer, turning off the mud pump; when a pressure value displayed on the third pressure gauge is zero, closing the throttle valve on the throttle manifold and the valve A;

S44: opening the throttle valve on the throttle manifold and the valve A; continuously injecting heavy mud by the top drive, such that a space above a position of the drill bit, as well as an interior and exterior of the drill pipe in the wellbore are filled with heavy mud to balance the pressure of the high-pressure saltwater layer; turning off the mud pump; and S5: transitioning to a drill-down mode, wherein the drill-down mode comprises the following steps:

S51: closing the first valve and the second valve; opening the valve A, the valve B, the valve C, the valve F, and the valve H; and closing the valve D, the valve E and the valve G;

S52: drilling with the drill bit on a bottom of the wellbore, turning on the mud pump; injecting the drilling fluid into the annulus of the wellbore sequentially through the mud pump, the second tee joint, the valve B, the first high-pressure manifold, the first high-pressure hose, the valve C, and the rotary blowout preventer; allowing a returned fluid to enter the mud tank sequentially through the top drive, the water hose, the third tee joint, the valve F, the second vertical pipe, the fourth tee joint, the valve H, the second high-pressure hose, the first tee joint, the valve A, the manifold, the liquid-gas separator, and the vibrating sieve; and S53: after all the heavy mud in the wellbore returns to the surface, repeating step S2.

8. The method according to claim 7, wherein in the step S24, the drilling is continued during a drainage of saltwater, and a returned high-pressure saltwater carries the plurality of cuttings back to the bottom of the wellbore through the drill pipe.

9. The method according to claim 7, wherein a first flow meter and a first pressure gauge are connected between the second port of the drilling spool and the first tee joint.

10. The method according to claim 9, wherein the second valve is connected between the second port of the drilling spool and the first flow meter; and the first valve is connected between the first port of the drilling spool and the kill manifold.

11. The method according to claim 7, wherein a second flow meter and a second pressure gauge are connected between the rotary blowout preventer and the valve C.

12. The method according to claim 7, wherein a third flow meter and a third pressure gauge are connected between the water hose and the third tee joint.

13. The method according to claim 7, further comprising an auxiliary equipment, the auxiliary equipment comprising a second ground pipeline, a liquid-gas separator, and a first ground pipeline, wherein the second ground pipeline is connected between the mud pump and the kill manifold, and the first ground pipeline and the liquid-gas separator are spatially connected to the throttle manifold.

* * * * *